US008001822B2

(12) United States Patent
Chadbourne

(10) Patent No.: US 8,001,822 B2
(45) Date of Patent: Aug. 23, 2011

(54) CRIMPING DIE

(75) Inventor: Christopher G. Chadbourne, Nashua, NH (US)

(73) Assignee: Hubbell Incorporated, Shelton, CT (US)

( * ) Notice: Subject to any disclaimer, the term of this patent is extended or adjusted under 35 U.S.C. 154(b) by 370 days.

(21) Appl. No.: 11/804,676

(22) Filed: May 18, 2007

(65) Prior Publication Data

US 2008/0282761 A1 Nov. 20, 2008

(51) Int. Cl.
*B21D 37/10* (2006.01)
*B21D 37/00* (2006.01)

(52) U.S. Cl. ..... 72/416; 72/412

(58) Field of Classification Search ..... 72/342.1, 72/342.4, 342.7, 342.8, 412–416, 478
See application file for complete search history.

(56) References Cited

U.S. PATENT DOCUMENTS

| | | | | |
|---|---|---|---|---|
| 1,305,873 | A | 6/1919 | Briggs | |
| 3,833,953 | A | 9/1974 | Fisher et al. | |
| 4,023,450 | A | 5/1977 | Ygfors | |
| 4,055,980 | A * | 11/1977 | Churla | 72/416 |
| 4,398,337 | A * | 8/1983 | Yamaguti et al. | 29/564.6 |
| 5,421,186 | A | 6/1995 | Lefavour | 72/416 |
| 5,485,641 | A | 1/1996 | Machmeier et al. | |
| 6,101,862 | A | 8/2000 | Rzasa et al. | 72/413 |
| 6,202,518 | B1 | 3/2001 | Moffitt, Jr. et al. | |
| 6,227,030 | B1 | 5/2001 | Lefavour et al. | 72/416 |
| 6,530,099 | B1 | 3/2003 | Iwinski | |
| 6,745,611 | B2 | 6/2004 | Lefavour et al. | |
| 6,768,059 | B1 | 7/2004 | Lefavour et al. | |
| 6,776,073 | B1 | 8/2004 | Brady et al. | |
| 6,792,789 | B1 | 9/2004 | Faucher | 72/456 |
| 6,966,244 | B2 | 11/2005 | Herbst et al. | |
| 7,493,791 | B2 * | 2/2009 | Chadbourne | 72/416 |
| 2003/0041453 | A1 | 3/2003 | Chadbourne | 29/861 |

OTHER PUBLICATIONS

Machinist-Materials, http://web.archive.org/web/20060411185306/http://www.machinist-materials.com/comparison_table_for_plastics.htm, Apr. 11, 2006, Table: Hardness Scale, pp. 1-6.*

CoorsTek, Inc., http://web.archive.org/web/20061021074319/http://www.coorstek.com/resources/8510-1364_Ceramic_Properties_MP.pdf, Oct. 21, 2006, pp. 1-4.*

* cited by examiner

*Primary Examiner* — Teresa M Ekiert
(74) *Attorney, Agent, or Firm* — Harrington & Smith

(57) ABSTRACT

A hydraulic crimping tool crimping die including a first section adapted to be removably connected to a die mounting area of a hydraulic crimping tool, and a second section forming a crimping surface adapted to crimp a connector onto a conductor. The crimping die comprises an electrically non-conductive material adapted to prevent electrical arcing with the crimping die.

14 Claims, 3 Drawing Sheets

CRIMPING DIE

BACKGROUND OF THE INVENTION

1. Field of the Invention

The invention relates to a crimping die and, more particularly, to a crimping die adapted to prevent electrical arcing with the crimping die.

2. Brief Description of Prior Developments

It is extremely common in the installation tooling industry to use metals in the manufacture of crimping or forming dies. This is obvious to one skilled in the art, due to the multiple benefits that alloy and stainless steels in particular provide to both the manufacturer and the user: manufacturing processes to shape steels are well known, material properties of these metals are well understood, raw materials are readily available. There is also a positive history using metals such as 4140 steel or 17-4PH stainless steels, for example as long lasting, non-yielding crimping dies.

Crimping dies for use in installing electrical connectors are very well known. An example, the BURNDY® U-die, is a semi-circular die with an outer profile which is manufactured to a known series of dimensions and tolerances. The inner profile of the 'U' shape is manufactured to certain dimensions and tolerances dependant on the shape which it is designed to crimp. As an example, a U shape die which is designed to crimp a #2 gauge connector would be designed with a smaller 'pocket' and features than would a die designed to crimp a 500,000 circular mil gauge connector. Though the design features are the same, the inner profile is designed to match the application. Other shape dies are also commonly known—"W" dies, "V" dies, and the like. Many of these designs are manufactured by many manufacturers skilled in the art.

However, there has been an increasing trend to use installation tools and crimping dies in 'live' applications, where the connector or connection which is being installed is done while power is flowing through the electrical circuit which is being connected to or tapped off. The increase in this phenomenon is primarily related to the continued reliance on continuous power requirements and the desire not to remove electrical circuits from service in order to repair or upgrade power transmission or distribution systems.

As such, in situations where connectors are being installed 'live', many dangers can become readily apparent and this creates problems. One of the primary phenomenon occurring during live installations is "arcing", where ionization of the air takes place causing electrical arcs. This occurs as a crimping tool and die set which is at a low potential is moved towards the live line which is at a high potential. This difference in potential will create sparks, arcing, and the like until the two components are at the same potential; at which time the arcing is mitigated.

This arcing can be dangerous to the user, who must be trained in the appropriate practices for live line installations. Also, arcing can cause severe damage to the components which are initially at the lower potential, to the point where the profile of the crimp dies can be altered by the heat and subsequent melting which are produced by the electrical arcs. This can render the die set unusable or inappropriate to use, in future applications. Further, there have been cases where the die set has fused to the crimp tool head permanently, rendering the die set and the tool unusable at a substantial cost to the user.

There is a desire to provide a crimping tool which can be used to perform "live" connector installations, but without arcing or sparks.

SUMMARY OF THE INVENTION

In accordance with one aspect of the invention, a hydraulic crimping tool crimping die is provided including a first section adapted to be removably connected to a die mounting area of a hydraulic crimping tool, and a second section forming a crimping surface adapted to crimp a connector onto a conductor. The crimping die comprises an electrically non-conductive material adapted to prevent electrical arcing with the crimping die.

In accordance with another aspect of the invention, a hydraulic crimping tool crimping die is provided comprising a first section adapted to be removably connected to a die mounting area of a hydraulic crimping tool, and a second section comprising a crimping surface adapted to crimp a connector onto a conductor. The crimping die comprises an electrically insulating material at a majority of an exterior surface of the die which is adapted to prevent electrical arcing with the die.

In accordance with another aspect of the invention, a method of manufacturing a hydraulic tool crimping die is provided comprising injecting a polymer material into a mold; and forming the crimping die in the mold with a first section adapted to be removably connected to a die mounting area of a hydraulic crimping tool and a second section having a crimping surface adapted to crimp a connector onto a conductor. The die is adapted to withstand a compression force of at least 10,000 psi without permanent deformation. The die is adapted to prevent electrical arcing with the die.

In accordance with another aspect of the invention, a method of manufacturing a hydraulic tool crimping die is provided comprising inserting a ceramic powder into a mold; and hardening the ceramic powder into at least a portion of the crimping die. The crimping die comprises a first section adapted to be removably connected to a die mounting area of a hydraulic crimping tool and second section forming a crimping surface adapted to crimp a connector onto a conductor. The die is adapted to withstand a compression force of at least 10,000 psi without permanent deformation. The die is adapted to prevent electrical arcing with the die.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENTS

Figure 1:
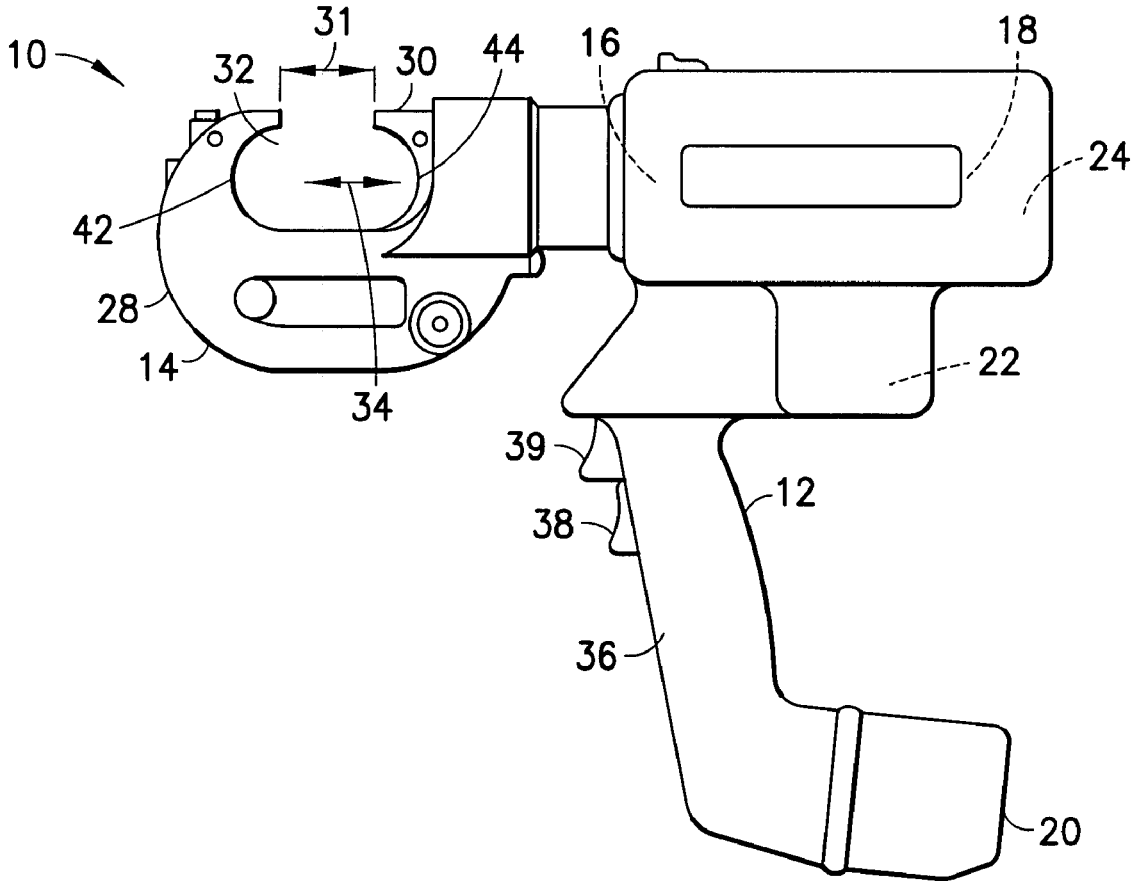
FIG. 1 PRIOR ART
FIG. 1 is a side view of a conventional crimping tool.

Referring to FIG. 1, there is shown an elevational side view of a conventional crimping tool 10. The tool 10 is merely described as an exemplary tool which the crimping dies of the present invention could be used with. The crimping dies could be used with any suitable type of crimping tool including, for example, a non-battery operated tool or a non-hydraulic tool.

The tool 10 generally comprises a frame 12, a working head 14, a pump 16, a motor 18, a battery 20, a fluid reservoir 22 and a controller 24. In alternate embodiments, the tool could comprise additional or alternative components. The frame 12 forms a ram hydraulic drive conduit system. The working head 14 comprises a frame section 28 and a ram 30. The frame section 28 is stationarily connected to the front end of the frame 12, but could be rotatable. The ram 30 is movably connected to the section 28. In the exemplary embodiment shown, the section 28 and the ram 30 are adapted to removably receive conductor crimping dies at a conductor receiving area 32.

The ram 30 is adapted to move forward and backward as indicated by arrow 34. The ram hydraulic drive conduit system is connected between the pump 16 and the rear end of the ram 30. Hydraulic fluid pumped by the pump 16 against the rear end of the ram 30 causes the ram 30 to move forward. The tool 10 preferably comprises a spring (not shown) which is adapted, as is known in the art, to return the ram 30 to its reward home position when hydraulic fluid pressure is released. In the exemplary embodiment shown, the ram 30 has a rear end diameter of about 2 in. However, in alternate embodiments, the rear end of the ram could have any suitable size or shape for functioning as a hydraulic fluid contact surface. In the exemplary embodiment shown, the ram 30 is adapted to move a distance 31 between its rear position and its forward position.

The frame 12 forms a handle 36. The battery 20 is removably connected to the bottom of the handle 36. However, in alternate embodiments, the frame 12 could comprise any suitable type of shape. In addition, the battery 20 could be removably mounted to any suitable position on the frame. The battery 20 might also be fixedly mounted to the tool and not be removable. The battery 20 is preferably a rechargeable battery. The handle 36 includes two user actuatable control triggers 38, 39. However, in alternate embodiments, any suitable type of user actuatable controls could be provided. The control triggers 38, 39 are operably coupled to the controller 24.

The motor 18 is coupled to the controller 24 and the battery 20. The controller 24 preferably comprises a printed circuit board. However, in alternate embodiments, any suitable type of controller could be provided. The motor 18 is controlled by the controller 24. The motor 18 is adapted to operate at a nominal voltage corresponding to the voltage of the battery 20. The output shaft of the motor 18 is connected to the pump 16 by a gear reduction or gearbox. Any suitable type of gear reduction assembly could be provided.

Figure 2:
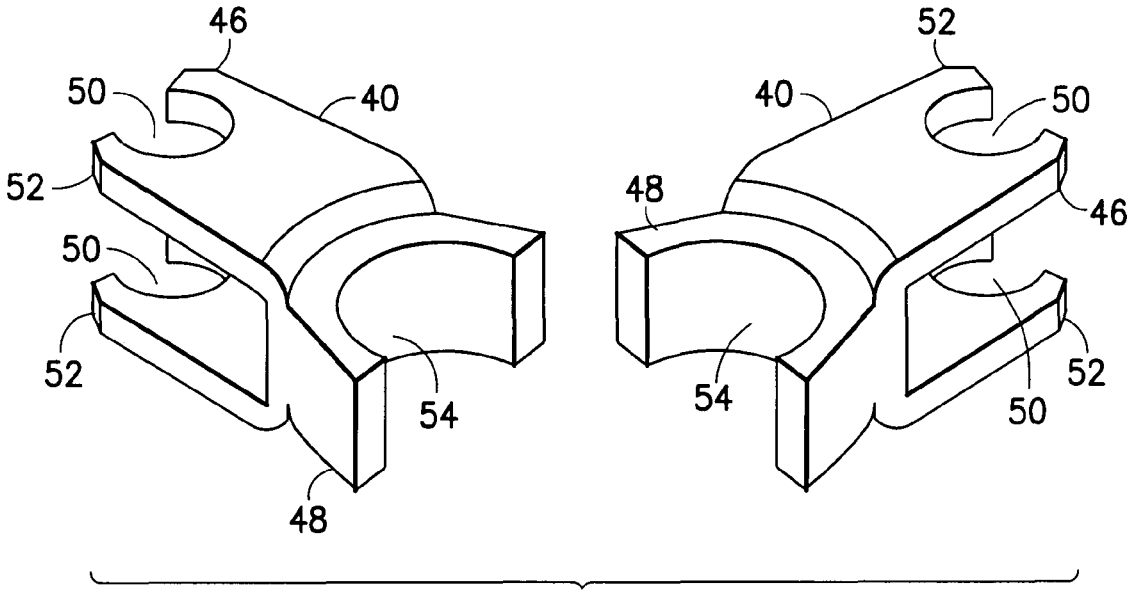
FIG. 2 is a perspective view of two dies comprising features of the invention.

Referring now also to FIG. 2, a pair of crimping dies 40 are shown incorporating features of the invention. Although the present invention will be described with reference to the exemplary embodiments shown in the drawings, it should be understood that the present invention can be embodied in many alternate forms of embodiments. In addition, any suitable size, shape or type of elements or materials could be used. The dies 40 are adapted to be removably mounted to the frame section 28 and the ram 30 at opposing locations 42, 44. The two locations 42, 44 form die mounting areas of the tool 10 for removably mounting the dies 40 to the tool. However, the dies 40 could be mounted to any suitable type of tool including, for example, a non-battery operated tool or a non-hydraulic tool.

In this embodiment, the dies 40 are identical to each other. However, in alternate embodiments the dies could be different. Each die 40 generally comprises a first section 46 and a second section 48. The first section 46 is adapted to removably mount the die to the frame section 28 or the ram 30. The frame section 28 and the ram 30 each have spring loaded latches with locking pins that can project into the apertures 50 in each leg 52 of the first section 46.

The second section 48 forms a crimping surface 54 adapted to crimp a connector onto a conductor. As the ram 30 is moved forward by the hydraulic drive system, one of the dies 40 is moved towards the other crimping die to compress or crimp an electrical connector therebetween. The connector is, thus, compressed or crimped onto one or more electrical conductors located in the connector. The size and shape of the surface 54 varies for different dies depending upon the size of the connector and conductors being crimped. Thus, the die 40 is selected based upon the size of the connector and conductors being crimped.

In the past, crimping dies were made from metal alloy or steel to withstand the high compression forces, such as from a 6, 12 or 15 Ton hydraulic pressure tool. The crimping dies had to withstand compressive forces of 14,000 psi and higher with repeated use over many years. As noted above, metal was the natural selection of material for the dies because of well known metal forming processes, relative inexpensive costs, and the proven ability to withstand the compression forces which a crimping die is subjected to.

However, also as noted above, there is a desire to use crimping tools under "live" (energized) conductor conditions. Steel dies are susceptible to arcing during "live" (energized) conductor conditions. The solution provided by the invention is to provide the crimping dies 40 designed with at least a portion of a high strength plastic composite or ceramic material. This will be substantially electrically non-conductive, in order to be impervious to damage due to arcing, as well as be suitably strong enough to withstand the compression forces seen during connector installations. This will also provide dies which are impervious to environmental aggressors which can cause corrosion, pitting, embrittlement, and the like. Such a design should be repeatable in its manufacture in order to insure design consistency and result in installation integrity.

Advances in the thermoplastics industry and ceramics industry have resulted in development of very strong materials which can withstand substantial stresses, primarily in compression, as crimping dies, especially U-type dies, are exposed to.

In a preferred embodiment, the dies 40 are manufactured by an injection molding method, with a high strength thermoplastic material such as DSM AKULON glass-filled resin or similar material. These materials and process method are beneficial because they provide a net shape. A net shape means that the process used to 'mold' the design results in a finished product which would not require subsequent machining operations. This also allows features such as crimp die index numbers or other text to be processed directly into the die during molding without subsequent operations. This, coupled with the substantially non-conductive nature of the raw material, result in a design which eliminates arcing damage and danger. Yet the resultant product provides for an acceptable crimp given the appropriate design parameters are maintained and have a substantial life. In a preferred embodiment, the die 40 is adapted to withstand a compression force of at least 10,000 psi without permanent deformation. However, in one type of embodiment die 40 is adapted to withstand a compression force of at least 14,000 psi without permanent deformation and will be able to have a good working life with repeated use without failure or producing non-good crimps.

Figure 3:
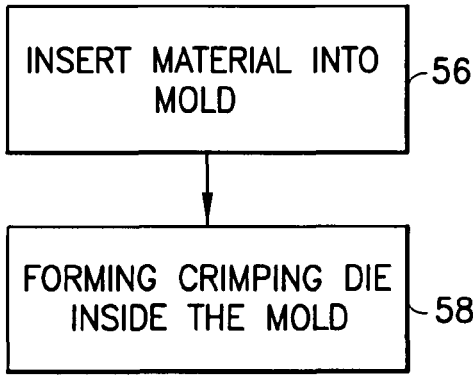
FIG. 3 is a diagram illustrating method steps of one method used to manufacture the crimping dies of the invention.

Referring also to FIG. 3, a diagram illustrating some steps in the manufacturing process is shown. As illustrated by block 56 material is injected into a mold. In the example described above, the material is a plastic or polymer material. As illustrated by block 58 the crimping die 40 is then formed inside the mold. With this example, step 58 comprises heating the mold to at least partially harden the material into its final shape. In one exemplary embodiment the plastic or polymer material forms the entire crimping die as a one-piece member.

It is also understood that in an alternate embodiment a ceramic material, such as molded in a power metallurgy process, would also yield a net shape and would also result in a substantially non-conductive design. Though strong in compression, ceramics limitations in tension would have to be understood and the design would have to incorporate features to practically eliminate any tension components in order to prevent premature breakage of the die. For this exemplary embodiment, in the diagram shown in FIG. 3 the ceramic material would be inserted into the mold as indicated by block 56 and at least partially subsequently hardened in the mold as indicated by block 58.

Figure 4:
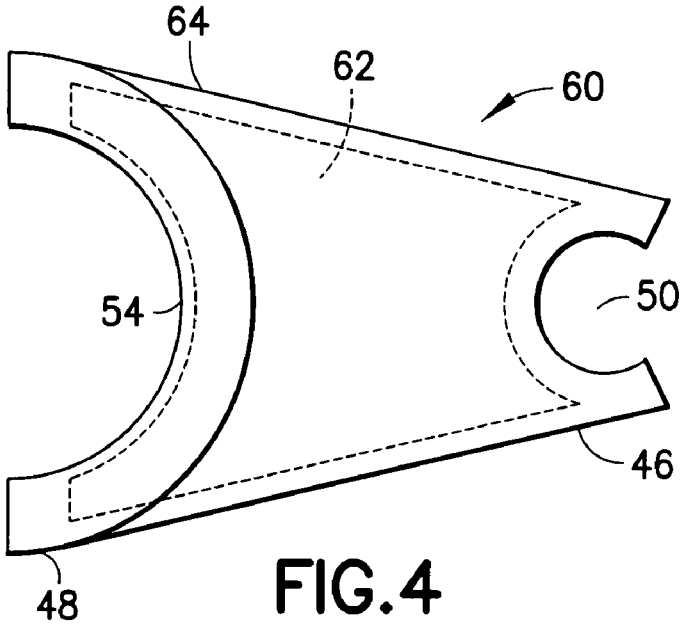
FIG. 4 is a side view of an alternate embodiment of a crimping die comprising features of the invention.

Lastly, a combination of an over-molded steel inner 'skeleton' member surrounded by thermoplastic composite or ceramic, would be an alternative that may mitigate the limitations of thermoplastics or ceramics with respect to tensile strength limitations. An example of this is shown in FIG. 4. As seen in FIG. 4, the die 60 comprises a core member 62 and an overmolded member 64. The overmolded member 64 could be a polymer or plastic member or a ceramic member which is overmolded onto the core member 62. With this type of embodiment, the core member 62, such as comprised of steel for example, would be placed in the mold and the material which forms the overmold member 64 would then be subsequently inserted into the mold and at least partially hardened in the mold onto the core member.

Figure 5:
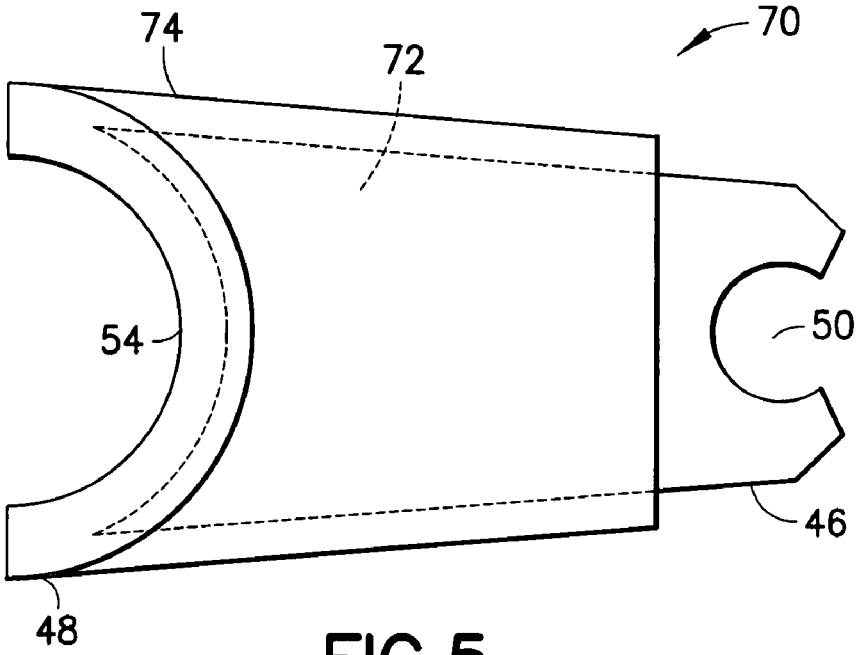
FIG. 5 is a side view of another alternate embodiment of a crimping die comprising features of the invention.

FIG. 5 shows another example of this type of multi-member crimping die comprising different materials. In FIG. 5 the crimping die 70 comprises a core member 72 and an overmolded member 74. The core member 72 could be steel for example. The overmolded member 74 could be a polymer or plastic member or a ceramic member which is overmolded onto the core member 72. The overmolded member 74 does not completely cover the core member 72. In this embodiment the overmold member 74 covers the second section 48, but not the first section 46. Thus, the core member 72 forms the first section 46 without the overmold member. In an alternate embodiment the surface 54 of the second section might not comprise the overmold material, but the second section might comprise the overmold material.

In one type of alternate embodiment and method, the insulating cover could be formed separate from the metal core member and subsequently attached to the metal core member. This attachment could be permanent or removable. Thus, the insulating cover does not need to be overmolded onto the core member(s).

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. A hydraulic crimping tool crimping die comprising a first section having legs adapted to be removably connected to a movable die mounting area of a hydraulic crimping tool, and a second section forming a crimping surface adapted to crimp a connector onto a conductor, wherein the legs extend from the second section in a general cantilever fashion with apertures at distal ends of the legs, wherein the apertures are adapted to removably receive locking pins of the movable die mounting area, wherein the crimping die consists of an electrically non-conductive material adapted to prevent electrical arcing with the crimping die, wherein the die is adapted to withstand a compression force of at least 10,000 psi without permanent deformation, and wherein the crimping die comprises an integral member having a metal core member and an insulating member formed over the metal core member.

2. A crimping die as in claim 1 wherein the crimping die comprises a one-piece member forming the first and second sections.

3. A crimping die as in claim 2 wherein the one-piece member comprises a plastic or polymer member.

4. A crimping die as in claim 2 wherein the one-piece member comprises a ceramic member.

5. A crimping die as in claim 1 wherein the crimping die comprises a plastic or polymer member forming a majority of the crimping die.

6. A crimping die as in claim 1 wherein the crimping die comprises an integral member having a ceramic member formed over a core member.

7. A hydraulic crimping tool crimping die comprising a first section adapted to be removably connected to a die mounting area of a hydraulic crimping tool at an aperture of the first section, and a second section comprising a crimping surface adapted to crimp a connector onto a conductor, wherein the crimping surface is opposite the aperture, wherein the crimping die comprises an electrically insulating material at a majority of an exterior surface of the die which is adapted to prevent electrical arcing with the die, wherein the die is adapted to withstand a compression force of at least 10,000 psi without permanent deformation, and wherein the crimping die comprises a metal core member and the insulating material overmolded on the metal core member.

8. A crimping die as in claim 7 wherein the crimping die comprises a one-piece member forming the first and second sections.

9. A crimping die as in claim 8 wherein the one-piece member comprises a plastic or polymer member.

10. A crimping die as in claim 8 wherein the one-piece member comprises a ceramic member.

11. A crimping die as in claim 7 wherein the crimping die comprises a plastic or polymer member forming a majority of the crimping die.

12. A crimping die as in claim 7 wherein the insulating material overmolded on the metal core member further comprises a ceramic member overmolded onto the core member.

13. A hydraulic crimping tool crimping the comprising a first section adapted to be removably connected to a die mounting area of a hydraulic crimping tool, and a second section comprising a crimping surface adapted to crimp a connector onto a conductor, wherein the crimping die comprises an electrically insulating material at a majority of an exterior surface of the die which is adapted to prevent electrical arcing with the die, wherein the crimping die comprises a one-piece member having a metal core member and the insulating material integrally formed over the metal core member, and wherein the insulating material covers the second section.

14. A hydraulic crimping tool crimping die as in claim 13 wherein a portion of the metal core member is not covered by the insulating material.

* * * * *